US011453986B2

(12) United States Patent
Janniello

(10) Patent No.: US 11,453,986 B2
(45) Date of Patent: Sep. 27, 2022

(54) INTELLIGENT SPEED REGULATOR

(71) Applicant: James P Janniello, Sarasota, FL (US)

(72) Inventor: James P Janniello, Sarasota, FL (US)

( * ) Notice: Subject to any disclaimer, the term of this patent is extended or adjusted under 35 U.S.C. 154(b) by 153 days.

(21) Appl. No.: 16/501,274

(22) Filed: Mar. 15, 2019

(65) Prior Publication Data

US 2019/0218729 A1 Jul. 18, 2019

Related U.S. Application Data

(63) Continuation of application No. 15/705,806, filed on Sep. 15, 2017, now Pat. No. 10,233,600.

(51) Int. Cl.

| | |
|---|---|
| ***E01F 9/529*** | (2016.01) |
| ***G08G 1/052*** | (2006.01) |
| ***E01F 13/12*** | (2006.01) |
| ***G08G 1/01*** | (2006.01) |
| ***G08G 1/02*** | (2006.01) |
| ***G08G 1/04*** | (2006.01) |
| ***E01F 15/00*** | (2006.01) |

(52) U.S. Cl.

CPC ..... *E01F 9/529* (2016.02); *E01F 13/12* (2013.01); *G08G 1/0116* (2013.01); *G08G 1/0145* (2013.01); *G08G 1/02* (2013.01); *G08G 1/04* (2013.01); *G08G 1/052* (2013.01); *E01F 15/00* (2013.01)

(58) Field of Classification Search

CPC ..... E01F 13/12; E01F 13/02; E01F 15/088; E01F 15/006; E01F 15/0492; E01F 15/086; E01F 15/146; E01F 15/143; E01F 15/141; E01F 9/529; E01F 13/123; E01F 13/048; G08G 1/052

See application file for complete search history.

(56) References Cited

U.S. PATENT DOCUMENTS

| | | | | |
|---|---|---|---|---|
| 5,267,808 | A * | 12/1993 | Welford | E01F 9/529 404/11 |
| 5,509,753 | A * | 4/1996 | Thompson | E01F 9/529 404/11 |
| 7,011,470 | B1 * | 3/2006 | Breazeale | E01F 9/529 404/10 |
| 7,114,873 | B2 * | 10/2006 | Rastegar | E01F 13/123 404/6 |
| 7,645,090 | B2 * | 1/2010 | Rastegar | E01F 13/123 404/15 |
| 9,951,487 | B1 * | 4/2018 | Gonzalez De Cosio Leal | E01F 9/529 |
| 2012/0282024 | A1 * | 11/2012 | Hua | E01F 9/529 404/15 |
| 2013/0209169 | A1 * | 8/2013 | Chew | E01F 13/048 404/15 |
| 2014/0227031 | A1 * | 8/2014 | Fifi | E01F 9/529 404/15 |
| 2015/0029042 | A1 * | 1/2015 | Ikeya | G08G 1/052 340/934 |

(Continued)

*Primary Examiner* — Abigail A Risic

(57) ABSTRACT

Methods, systems, and apparatus for controlling a speed regulator are described. A monitor detects a speed of a vehicle. A speed regulator controller retracts the speed regulator from an extended configuration to a retracted configuration based on the detected speed in response to the vehicle traveling at a speed less than a defined speed, the speed regulator being configurable to extend and retract.

21 Claims, 7 Drawing Sheets

(56) References Cited

U.S. PATENT DOCUMENTS

| | | | | |
|---|---|---|---|---|
| 2015/0252540 | A1* | 9/2015 | Lee | E01F 13/123<br>404/6 |
| 2016/0312416 | A1* | 10/2016 | Shi | E01F 9/529 |
| 2017/0081814 | A1* | 3/2017 | Zwerneman | E01F 9/529 |
| 2018/0298570 | A1* | 10/2018 | Abu Al-Rubb | E01F 13/126 |

* cited by examiner

INTELLIGENT SPEED REGULATOR

CLAIM OF PRIORITY

This application claims the benefit of priority under 35 U.S.C. § 119(e) of U.S. patent application Ser. No. 15/705,806, filed on Sep. 15, 2017, which is incorporated by reference herein in their entirety.

TECHNICAL FIELD

The present application relates generally to controlling the speed of a vehicle, and more specifically, in one example, to controlling a speed regulator.

BACKGROUND

Automobiles often exceed safe and/or posted speed limits. Drivers may ignore or not recognize a posted speed limit sign, or may otherwise exceed a safe speed limit. Congested areas, such as areas with pedestrians, limited sight areas, areas with complex traffic patterns, and the like often warrant speeds slower than many drivers choose to drive. To curb the speed of drivers, speed regulators, such as speed bumps, speed humps, and the like, or a series of speed bumps, speed humps, and the like, are used in many areas, such as parking lots, residential neighborhoods, apartment complexes, toll collection areas, and the like. Often, the speed regulators frustrate drivers who naturally drive at safe speeds. In addition, drivers who tend to exceed a safe or posted speed limit may simply quickly accelerate after passing a first speed regulator and then quickly decelerate before encountering the next speed regulator, thereby diminishing the effectiveness of the speed regulators.

BRIEF DESCRIPTION OF THE DRAWINGS

Some embodiments are illustrated by way of example and not limitation in the figures of the accompanying drawings, in which.

DETAILED DESCRIPTION

Figure 1:
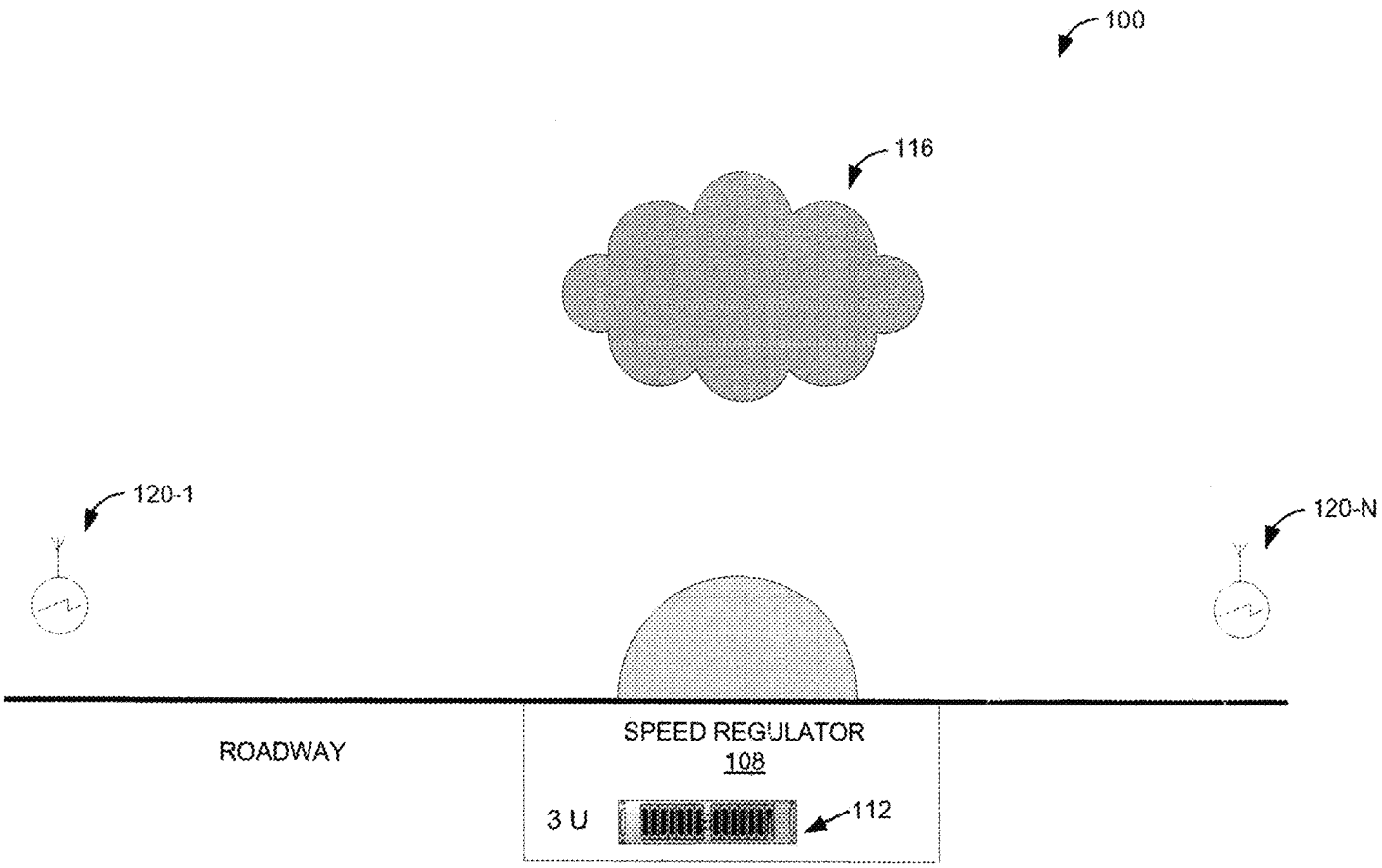
FIG. 1 is a block diagram of an example speed regulation system, in accordance with an example embodiment.

In the following detailed description of example embodiments of the invention, reference is made to specific examples by way of drawings and illustrations. These examples are described in sufficient detail to enable those skilled in the art to practice the inventive subject matter, and serve to illustrate how the invention may be applied to various purposes or embodiments. Other example embodiments of the inventive subject matter exist and are within the scope of the disclosure, and logical, mechanical, electrical, and other changes may be made without departing from the scope or extent of the present inventive subject matter. Features or limitations of various embodiments of the invention described herein, however essential to the example embodiments in which they are incorporated, do not limit the inventive subject matter as a whole, and any reference to the inventive subject matter, its elements, operation, and application do not limit the inventive subject matter as a whole but serve only to define these example embodiments. The following detailed description does not, therefore, limit the scope of the inventive subject matter, which is defined only by the appended claims.

Generally, methods, apparatus, and systems for controlling a speed regulator and a speed of a vehicle are disclosed. In one example embodiment, a retractable speed regulator is intelligently controlled. The speed regulator may have a default position that is either fully retracted, partially retracted, or protruding (also known as extended herein) from a roadway, such as a driveway, a street, a highway, a parking lot, a parking garage, and the like. In one example embodiment, as a vehicle approaches the retractable speed regulator, the speed of the vehicle is measured. In one example embodiment, if the vehicle is exceeding a defined speed, the speed regulator is raised into or maintained in the extended configuration. If the vehicle is traveling at a speed under the defined speed, the speed regulator is retracted prior to the vehicle encountering the speed regulator or maintained in the retracted position.

Absolute Behavior

In one example embodiment, the speed regulator is retracted when the detected speed of the vehicle is below the defined speed, or is maintained in the retracted position when the detected speed of the vehicle is below the defined speed. If the initial speed of the vehicle is above the defined speed or if the speed of the vehicle should accelerate to exceed the defined speed (after first being detected at a speed below the defined speed), the speed regulator, if retracted or partially retracted, may be extended or may be maintained in the extended position.

Relative Behavior

In one example embodiment, a user may define the rule(s) (including conditions) for the speed regulator to remain in the extended position or to move into the extended position, and may define the condition(s) for the the speed regulator to remain in the retracted (or partially retracted) position or to move into the retracted, or a partially retracted (e.g., less than fully retracted), position. For example, a user may specify a rule that indicates that the vehicle will be allowed to pass over a retracted speed regulator only if the average speed of the vehicle during the monitoring period is below the defined speed.

Early and Late Retraction

In one example embodiment, the speed regulator, if extended, is retracted if the behavior of the vehicle meets a predefined rule(s). In one example embodiment, the speed regulator is retracted just prior to the vehicle encountering the speed regulator. For example, the speed regulator may be retracted when the vehicle is a defined distance from the speed regulator, may be retracted a specified amount of time after the vehicle is first detected, may be retracted based on an estimated time of the vehicle encountering the speed regulator (as determined by the vehicle's measured speed, measured distance from the speed regulator, or both), and the like. In one example embodiment, the speed regulator, if extended, is retracted once the vehicle is determined to meet the predefined rule(s). The speed regulator may be extended if the vehicle is determined to violate the predefined rule(s).

Restrictions to Reconfiguration

In one example embodiment, a retracted or partially retracted speed regulator will not be raised if the vehicle is within a predefined distance of the speed regulator. This may be done for safety reasons. For example, the speed regulator may not be extended if the vehicle is within three seconds of travel time or 20 feet of the speed regulator. The distance of the vehicle from the speed regulator may be measured, may be estimated based on a measured speed of the vehicle, may be detected based on a location sensor, and the like.

FIG. 1 is a block diagram of an example speed regulation system 100, in accordance with an example embodiment. In one example embodiment, the speed regulation system 100 may comprise a speed regulator 108, a speed regulator processing system 112, a network 116, and one or more monitors 120-1, . . . 120-N (collectively known as monitors 120 hereinafter). One or more of the monitors 120 may be housed within or collocated with the speed regulator processing system 112. In addition, the speed regulator processing system 112 and one or more of the monitors 120 may be housed within or collocated with the speed regulator 108.

The speed regulator 108 may be configured to be fully retracted, partially retracted, or protruding from a roadway. The position of the speed regulator 108 may be altered by a process of extending, retracting, raising, lowering, rotating, flexing, inflating, deflating, and the like (depending on the type of speed regulator 108). For example, an inflatable speed regulator 108 may be inflated with a liquid or gas to protrude from a roadway and may be deflated to retract into the roadway or onto the surface of the roadway, as described more fully below by way of example in conjunction with FIG. 3A.

A semi-cylindrical speed regulator 108 may be rotated into a position such that the speed regulator 108, or a portion of the speed regulator 108, protrudes from the roadway. A flexible speed regulator 108 or a segmented speed regulator 108 may be raised, or partially raised, using, for example, a pneumatic piston(s), as described more fully below by way of example in conjunction with FIGS. 3B and 3C.

The speed regulator processing system 112 may include a processor (e.g., a central processing unit (CPU), a graphics processing unit (GPU), and the like) and a memory, which communicate with each other via a bus. The speed regulator processing system 112 may further include a video display (e.g., a plasma display, a liquid crystal display (LCD), or a cathode ray tube (CRT)). The speed regulator processing system 112 may also include an alphanumeric input device (e.g., a keyboard), a user interface (UI) navigation device (e.g., a mouse and/or touch screen), a drive unit, a signal generation device (e.g., a speaker), and a network interface device.

The drive unit, such as a removable drive unit, includes a machine-readable medium on which is stored one or more sets of instructions and data structures embodying or utilized by any one or more of the methodologies or functions described herein. The instructions may also reside, completely or at least partially, within the memory and/or within the processor during execution thereof by the computer processing system. The instructions may further be transmitted or received over the network 116 via the network interface device utilizing any one of a number of well-known transfer protocols (e.g., Hypertext Transfer Protocol (HTTP)).

The network 116 may be a local area network (LAN), a wireless network, a metropolitan area network (MAN), a wide area network (WAN), a wireless network, a network of interconnected networks, the public switched telephone network (PSTN), an electrical power-based network (such as the X.10 protocol), and the like. Communication links include, but are not limited to, WiFi (e.g., IEEE 802.11), Bluetooth, Universal Serial Bus (USB), and the like. In one example embodiment, the network 116 may comprise one or more routers and/or device switches (not shown).

Each monitor 120 monitors a speed of a vehicle, an acceleration of a vehicle, a location of a vehicle, any combination thereof, and the like. The speed and acceleration may be measured using a radar system, a camera system, and the like. Each monitor 120 may communicate with the speed regulator processing system 112 via the network 116 or a communication link of the network 116.

Figure 2:
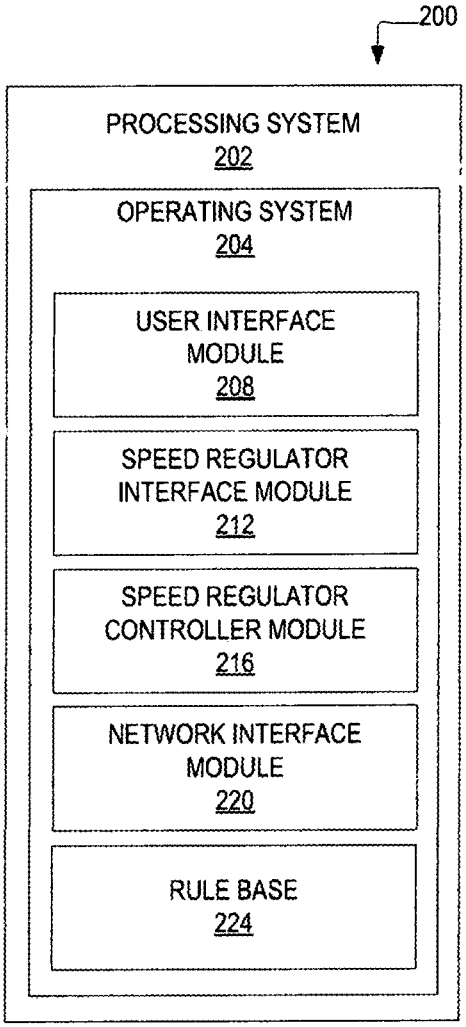
FIG. 2 is a block diagram of an example apparatus for controlling a speed regulator, in accordance with an example embodiment.

FIG. 2 is a block diagram of an example apparatus 200 for controlling the speed regulator 108, in accordance with an example embodiment. In one example embodiment, the apparatus 200 may serve as the speed regulator processing system 112.

The apparatus 200 is shown to include a processing system 202 that may be implemented on a server, client, or other processing device that includes an operating system 204 for executing software instructions. In accordance with an example embodiment, the processing system 202 may include a user interface module 208, a speed regulator interface module 212, a speed regulator controller module 216, a network interface module 220, and a rule base 224.

The user interface module 208 provides an interface for configuring the speed regulation system 100 and defining rules of the rule base 224. For example, a defined speed limit may be specified via the user interface module 208. The default configuration of the speed regulator 108 (e.g., extended, retracted, and partially retracted), the criteria for changing the configuration of the speed regulator 108, the behavior of the speed regulation system 100, and the like may be specified via the user interface module 208. A user interface generated by the user interface module 208 is described more fully below by way of example in conjunction with FIG. 5.

The speed regulator interface module 212 provides an interface to the speed regulator 108. The speed regulator 108 may provide a status (e.g., extended, retracted, or partially retracted) of the speed regulator 108 to the speed regulator controller module 216 via the speed regulator interface module 212 and the speed regulator controller module 216 may issue commands via the speed regulator interface module 212 to, for example, implement a selected configuration of the speed regulator 108.

The speed regulator controller module 216 receives data from each monitor 120 via the network interface module 220 and processes the data to determine the configuration of the speed regulator 108 based, for example, on a speed of a vehicle, an acceleration of a vehicle, a location of a vehicle, and the like, as described more fully below by way of example in conjunction with FIG. 4. The speed regulator controller module 216 instructs the speed regulator 108 to implement a specified configuration.

The network interface module 220 provides an interface to the network 116. Data from each monitor 120 may be transferred via the network interface module 220 to the speed regulator controller module 216 and commands may be issued via the network interface module 220 to the speed regulator 108.

The rule base 224 comprises a rule(s) for processing data received from the monitors 120 and determining a configuration of the speed regulator 108, as described more fully below by way of example in conjunction with FIGS. 4 and 5.

Figure 3B:
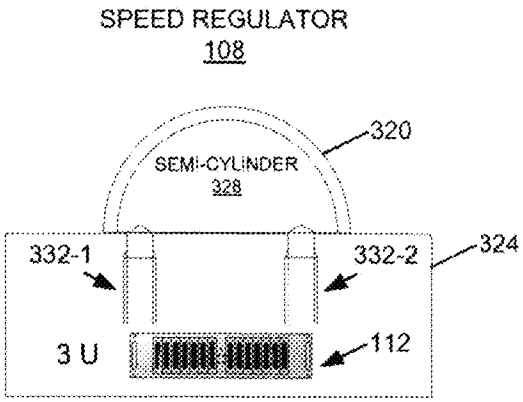
FIGS. 3B and 3C illustrate an end view and side view, respectively, of a second example embodiment of a speed regulator, in accordance with an example embodiment.
Figure 3C:
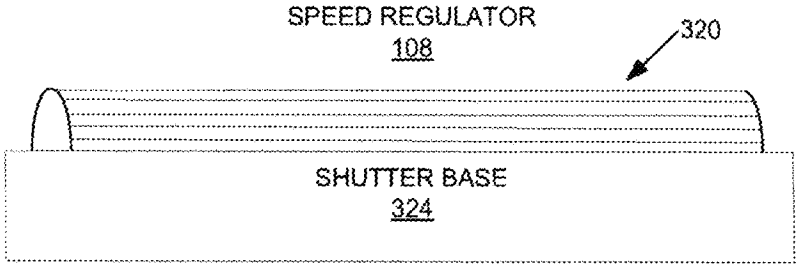
Figure 3A:
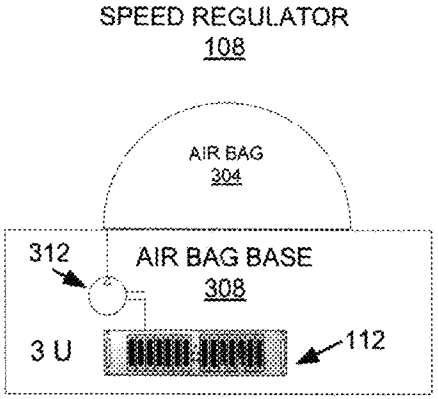
FIG. 3A is a diagram of a first example embodiment of a speed regulator, in accordance with an example embodiment.

FIG. 3A is a diagram of a first example embodiment of the speed regulator 108, in accordance with an example embodiment. The speed regulator 108 comprises an inflatable air bag 304 in the shape of a semi-cylinder (as used herein, a semi-cylinder is one half of a cylinder, the cylinder being sliced in half through the central axis of the cylinder). The inflatable air bag 304 is attached to an air bag base 308 that houses an air pump 312. The air pump 312 is controlled by the speed regulator controller module 216 of the speed regulator processing system 112 via the speed regulator interface module 212. The air pump 312 is configured to inflate the inflatable air bag 304 and to deflate the inflatable air bag 304 based on commands from the the speed regulator controller module 216. The air bag base 308 may be recessed in a roadway such that the top surface of the air bag base 308 is level with the top surface of the roadway.

FIGS. 3B and 3C illustrate an end view and side view, respectively, of a second example embodiment of the speed regulator 108, in accordance with an example embodiment. The speed regulator 108 comprises a plurality of flat shutters 320 that are hinged together (known as segmented herein). In the retracted configuration, the flat shutters 320 are recessed in a shutter base 324 such that the flat shutters 320 lay flat, in line with the top surface of the shutter base 324. The shutter base 324 may be recessed in a roadway such that the top surface of the shutter base 324 is level with the top surface of the roadway. In the extended mode, a semi-cylinder 328 that is beneath the flat shutters 320 and having a center axis that is parallel to the flat shutters 320 is raised, causing the flat shutters 320 to protrude from the shutter base 324 in the general shape of a half-cylinder. In one example embodiment, the semi-cylinder 328 is raised by pneumatic pistons 332-1, 332-2 at one end of the semi-cylinder 328 (as shown) and pneumatic pistons 332-3, 332-4 at the other end of the semi-cylinder 328 (not shown). In one example embodiment, the semi-cylinder 328 is composed of an axle that impales a plurality of parallel wheels or disks (not shown).

Figure 4:
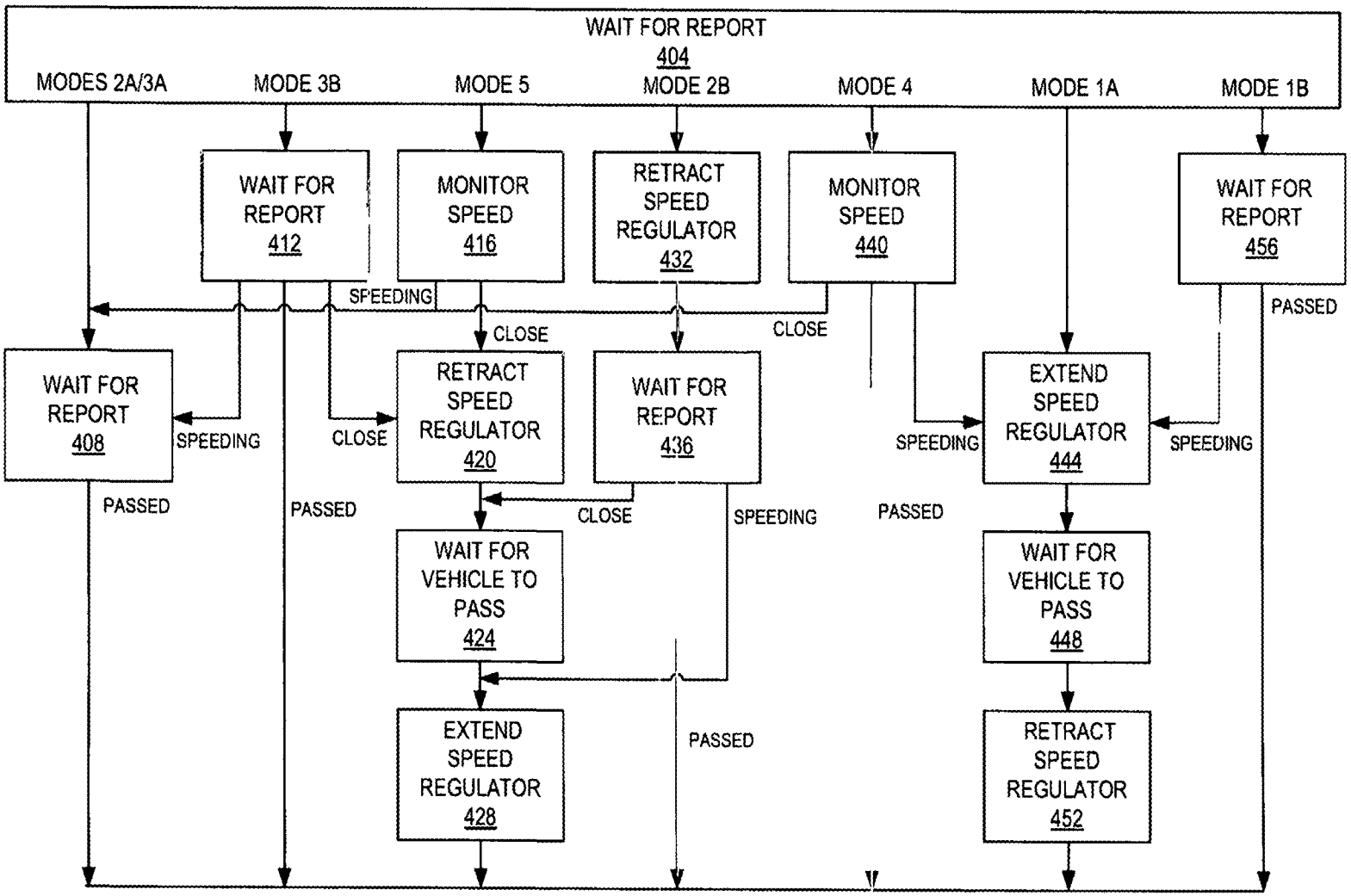
FIG. 4 is a flowchart for an example method for controlling a speed regulator, in accordance with an example embodiment.

FIG. 4 is a flowchart for an example method 400 for controlling the speed regulator 108, in accordance with an example embodiment. In one example embodiment, one or more of the operations of the method 400 may be performed by the speed regulator processing system 112.

In one example embodiment, a check for a report from one of the monitors 120 may be performed (operation 404). For example, a check for a report of an approaching vehicle may be performed. If a report of an approaching vehicle is not received, operation 404 is repeated; otherwise, the received report is parsed to, for example, determine the speed of the approaching vehicle.

Absolute/Normally Retracted Mode

If the speed of the vehicle is exceeding the defined speed and the mode is set to absolute/normally retracted (mode 1A), the speed regulator 108 is moved into the extended configuration (operation 444) and the method 400 proceeds to operation 448. (As used herein, a normally retracted mode is a mode where the default configuration of the speed regulator 108 is retracted and a normally extended mode is a mode where the default configuration of the speed regulator 108 is extended.)

During operation 448, the method 400 waits for a monitor report (e.g., a report from one of the monitors 120) indicating the vehicle has passed the speed regulator 108. The passing of a vehicle may be detected, for example, by a pressure sensor within the speed regulator 108. If a monitor report is received indicating the vehicle has passed the speed regulator 108, the speed regulator 108 is moved into the retracted configuration (operation 452) and the method 400 proceeds to operation 404.

If the speed of the vehicle is not exceeding the defined speed and the mode is set to absolute/normally retracted (mode 1B), the method 400 waits for a monitor report (operation 456). If the next report indicates the vehicle is exceeding the defined speed, the speed regulator 108 is moved into the extended position (operation 444) and the method 400 proceeds with operation 448. If, during operation 456, the next report indicates the vehicle has passed the speed regulator 108, the method 400 proceeds to operation 404. In one example embodiment (not shown in FIG. 4), if the vehicle becomes within a predefined distance of the speed regulator 108 (based on a spatial distance or an amount of travel time) during operation 456, the method 400 proceeds to operation 408.

Absolute Mode/Normally Extended/Retract Early

If the speed of the vehicle is exceeding the defined speed and the mode is set to absolute/normally extended/retract early (mode 2A), the method 400 waits for a report indicating the vehicle has passed the speed regulator 108 (operation 408).

If the speed of the vehicle is not exceeding the defined speed and the mode is set to absolute/normally extended/retract early (mode 2B), the speed regulator 108 is sent a command to move into the retracted position (operation 432) and the method 400 waits for a report (operation 436). During operation 436, if the next report indicates the vehicle is exceeding the defined speed, the speed regulator 108 is moved into the extended configuration (operation 428). During operation 436, if the next report indicates the vehicle is within a defined distance of the speed regulator 108, the method 400 proceeds to operation 424. During operation 436, if the next monitor report indicates that the vehicle has passed, the method 400 proceeds to operation 404.

Absolute Mode/Normally Extended/Retract Late

If the speed of the vehicle is exceeding the defined speed and the mode is set to absolute/normally extended/retract late (mode 3A), the method 400 waits for a report indicating the vehicle has passed the speed regulator 108 (operation 408).

If the speed of the vehicle is not exceeding the defined speed and the mode is set to absolute/normally extended/retract late (mode 3B), the method 400 waits for a report (operation 412). During operation 412, if the next report indicates the vehicle is exceeding the defined speed, the method 400 proceeds to operation 408. During operation 412, if the next report indicates the vehicle is close to the speed regulator 108, the speed regulator 108 is retracted (operation 420) and the method 400 waits for a report indicating the vehicle has passed the speed regulator 108 (operation 424). During operation 412, if the next report indicates the vehicle has passed the speed regulator 108, the method 400 proceeds to operation 404. During operation 424, if a report is received indicating the vehicle has passed the speed regulator 108, the speed regulator 108 is sent a command to move into the extended position (operation 428) and the method 400 then proceeds to operation 404.

Relative Mode/Normally Retracted

If the mode is set to relative/normally retracted (mode 4), the speed of the vehicle is continuously, or nearly continuously, monitored (operation 440). If the speed of the vehicle violates the defined speed such that the vehicle cannot recover to meet the requirements of the rules of the relative mode, the speed regulator 108 is sent a command to move into the extended configuration (operation 444) and the method 400 proceeds with operation 448. For example, a rule may indicate that the average speed of the vehicle is to be less than the defined speed. If it is not possible for the average speed of the vehicle to be less than the defined speed during the remaining monitoring period, the speed of the vehicle violates the rule. If the speed of the vehicle satisfies the rules of the relative mode and the next report indicates the vehicle is within a defined distance of the speed regulator 108, the method 400 waits for a report indicating the vehicle has passed the speed regulator 108 (operation 408). If the next report indicates the vehicle has passed the speed regulator 108, the method 400 proceeds to operation 404.

Relative Mode/Normally Extended

If the mode is set to relative/normally extended (mode 5), the speed of the vehicle is continuously, or nearly continuously, monitored (operation 416). If the speed of the vehicle violates the defined speed and the rules of the relative mode such that the vehicle cannot recover to meet the requirements of the rules of the relative mode, the method 400 proceeds with operation 408. If the speed of the vehicle satisfies the rules of the relative mode and the next report indicates the vehicle is close to the speed regulator 108, the speed regulator 108 is retracted (operation 420) and the method 400 waits for a report indicating the vehicle has passed the speed regulator 108 (operation 424). During operation 424, if a report is received indicating the vehicle has passed the speed regulator 108, the speed regulator 108 is sent a command to move into the extended position (operation 428) and the method 400 then proceeds to operation 404.

In one example embodiment, if other vehicles are within a predefined distance of the speed regulator 108 (e.g., a convoy of vehicles) when the method 400 is being executed for a lead vehicle of the convoy, the convoy of vehicles will be treated as a single vehicle. For example, if the speed regulator 108 is retracted for the lead vehicle of the convoy, the speed regulator 108 will remain retracted until the last vehicle of the convoy passes the speed regulator 108. Similarly, if the speed regulator 108 is extended for the lead vehicle of the convoy, the speed regulator 108 will remain extended until the last vehicle of the convoy passes the speed regulator 108. The speed regulator 108 may then be set in the default configuration when the last vehicle of the convoy passes the speed regulator 108. The last vehicle of the convoy may be identified by an absence of a vehicle within the predefined distance of the speed regulator 108 after the lead vehicle encounters the speed regulator 108.

Figure 5:
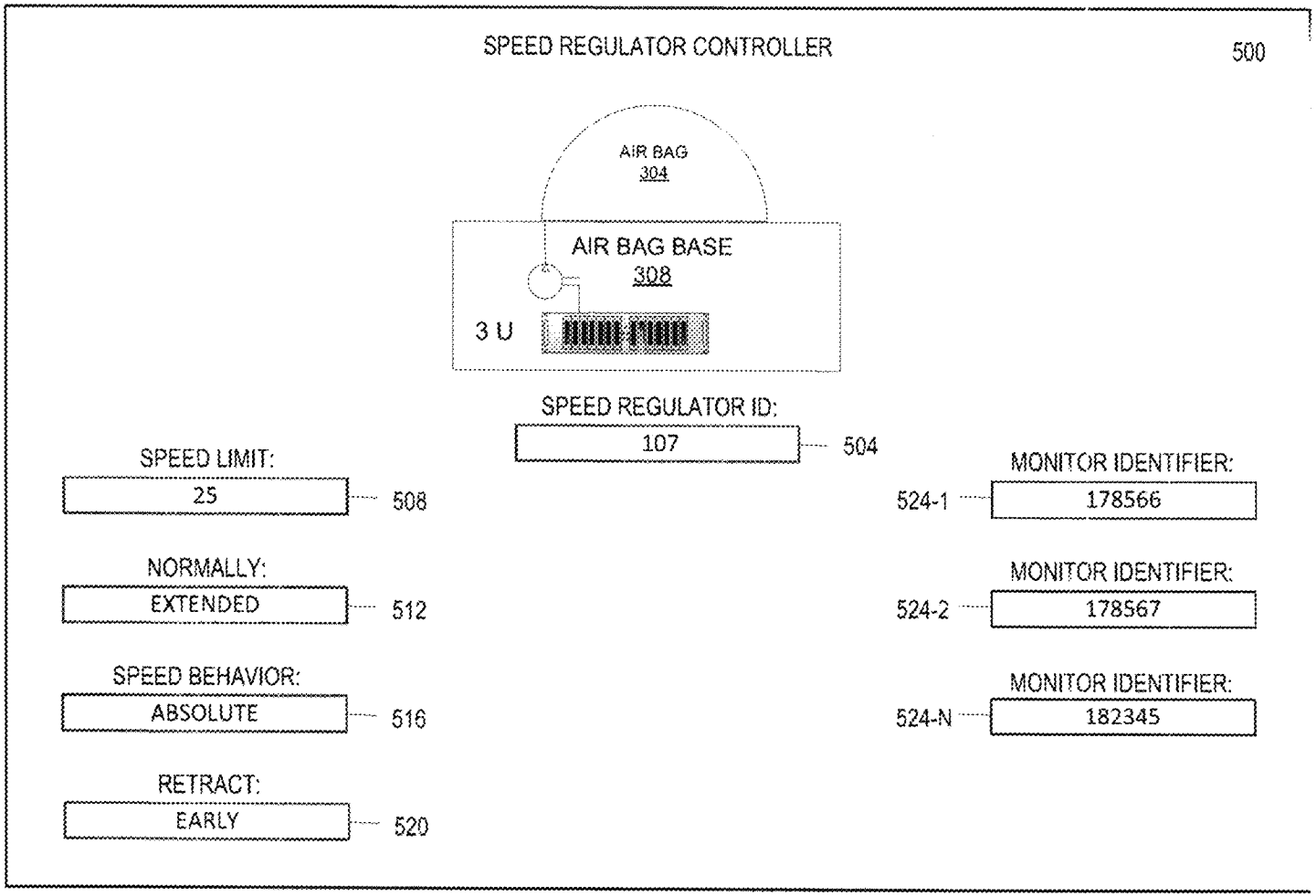
FIG. 5 illustrates an example user interface for configuring the speed regulation system, in accordance with an example embodiment.

FIG. 5 illustrates an example user interface 500 for configuring the speed regulation system 100, in accordance with an example embodiment. The user interface 500 may be generated by, for example, the user interface module 208.

As illustrated in FIG. 5, the user interface 500 comprises a speed regulator identification field 504 for entering an identity of the speed regulator 108 to be configured (for instances where a plurality of speed regulators 108 are connected to the network 116), a speed limit field 508 for entering the defined speed limit, a first mode field 512 for entering the speed regulator mode (normally extended or normally retracted), a second mode field 516 for entering the behavior mode (absolute or relative), and a third mode field 520 for entering the retraction time (early or late). The user interface 500 comprises one or more monitor identification fields 524-1, . . . 524-N for entering an identity of the monitors 120 to be configured (for instances where a plurality of monitors 120 are connected to the network 116).

Although certain examples are shown and described here, other variations exist and are within the scope of the inventive subject matter. It will be appreciated, by those of ordinary skill in the art, that any arrangement, which is designed or arranged to achieve the same purpose, may be substituted for the specific embodiments shown. This application is intended to cover any adaptations or variations of the example embodiments of the invention described herein. It is intended that this disclosure be limited only by the claims, and the full scope of equivalents thereof.

Example Mobile Device

Figure 6:
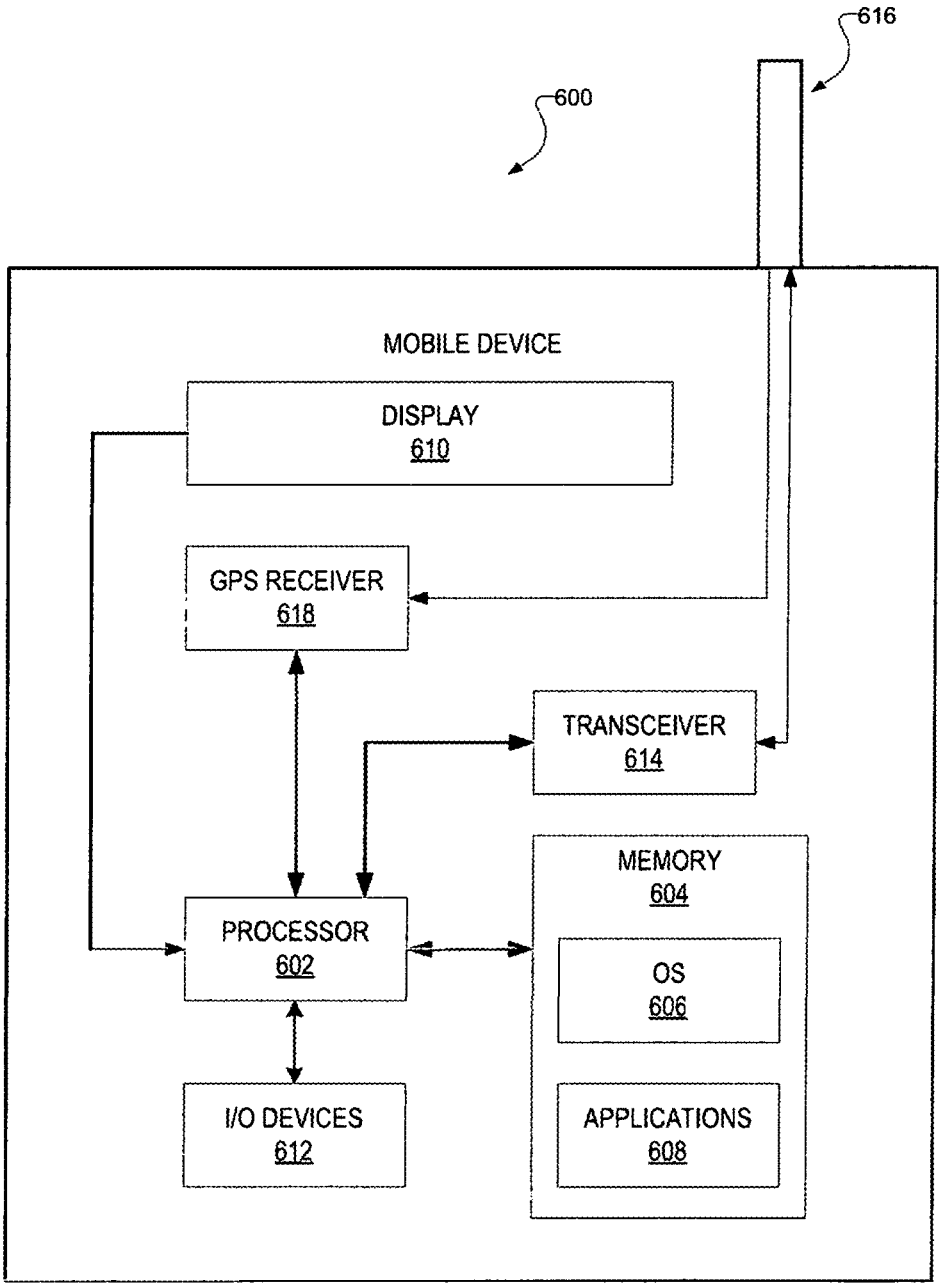
FIG. 6 is a block diagram illustrating an example mobile device, according to an example embodiment.

FIG. 6 is a block diagram illustrating an example mobile device 600, according to an example embodiment. The mobile device 600 may include a processor 602. The processor 602 may be any of a variety of different types of commercially available processors suitable for mobile devices (for example, an XScale architecture microprocessor, a microprocessor without interlocked pipeline stages (MIPS) architecture processor, or another type of processor 602). A memory 604, such as a random access memory (RAM), a flash memory, or another type of memory, is typically accessible to the processor 602. The memory 604 may be adapted to store an operating system (OS) 606, as well as application programs 608, such as a mobile location enabled application that may provide location-based services (LBSs) to a user. The processor 602 may be coupled, either directly or via appropriate intermediary hardware, to a display 610 and to one or more input/output (I/O) devices 612, such as a keypad, a touch panel sensor, a microphone, and the like. Similarly, in some embodiments, the processor 602 may be coupled to a transceiver 614 that interfaces with an antenna 616. The transceiver 614 may be configured to both transmit and receive cellular network signals, wireless data signals, or other types of signals via the antenna 616, depending on the nature of the mobile device 600. Further, in some configurations, a GPS receiver 618 may also make use of the antenna 616 to receive GPS signals.

Modules, Components and Logic

Certain embodiments are described herein as including logic or a number of components, modules, or mechanisms. Modules may constitute either software modules (e.g., code embodied (1) on a non-transitory machine-readable medium or (2) in a transmission signal) or hardware-implemented modules. A hardware-implemented module is a tangible unit capable of performing certain operations and may be configured or arranged in a certain manner. In example embodiments, one or more computer systems (e.g., a standalone, client, or server computer system) or one or more processors may be configured by software (e.g., an application or application portion) as a hardware-implemented module that operates to perform certain operations as described herein.

In various embodiments, a hardware-implemented module may be implemented mechanically or electronically. For example, a hardware-implemented module may comprise dedicated circuitry or logic that is permanently configured (e.g., as a special-purpose processor, such as a field programmable gate array (FPGA) or an application-specific integrated circuit (ASIC)) to perform certain operations. A hardware-implemented module may also comprise programmable logic or circuitry (e.g., as encompassed within a general-purpose processor or other programmable processor) that is temporarily configured by software to perform certain operations. It will be appreciated that the decision to implement a hardware-implemented module mechanically, in dedicated and permanently configured circuitry, or in temporarily configured circuitry (e.g., configured by software) may be driven by cost and time considerations.

Accordingly, the term "hardware-implemented module" should be understood to encompass a tangible entity, be that an entity that is physically constructed, permanently configured (e.g., hardwired) or temporarily or transitorily configured (e.g., programmed) to operate in a certain manner and/or to perform certain operations described herein. Considering embodiments in which hardware-implemented modules are temporarily configured (e.g., programmed), each of the hardware-implemented modules need not be configured or instantiated at any one instance in time. For example, where the hardware-implemented modules comprise a general-purpose processor configured using software, the general-purpose processor may be configured as respective different hardware-implemented modules at different times. Software may accordingly configure a processor, for example, to constitute a particular hardware-implemented module at one instance of time and to constitute a different hardware-implemented module at a different instance of time.

Hardware-implemented modules can provide information to, and receive information from, other hardware-implemented modules. Accordingly, the described hardware-implemented modules may be regarded as being communicatively coupled. Where multiples of such hardware-implemented modules exist contemporaneously, communications may be achieved through signal transmission (e.g., over appropriate circuits and buses that connect the hardware-implemented modules). In embodiments in which multiple hardware-implemented modules are configured or instantiated at different times, communications between such hardware-implemented modules may be achieved, for example, through the storage and retrieval of information in memory structures to which the multiple hardware-implemented modules have access. For example, one hardware-implemented module may perform an operation and store the output of that operation in a memory device to which it is communicatively coupled. A further hardware-implemented module may then, at a later time, access the memory device to retrieve and process the stored output. Hardware-implemented modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but deployed across a number of machines. In some example embodiments, the processor or processors may be located in a single location (e.g., within a home environment, an office environment, or a server farm), while in other embodiments the processors may be distributed across a number of locations.

The one or more processors may also operate to support performance of the relevant operations in a "cloud computing" environment or as a "software as a service" (SaaS). For example, at least some of the operations may be performed by a group of computers (as examples of machines including processors), these operations being accessible via a network (e.g., the Internet) and via one or more appropriate interfaces (e.g., application program interfaces (APIs)).

Electronic Apparatus and System

Example embodiments may be implemented in digital electronic circuitry, or in computer hardware, firmware, or software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor, a computer, or multiple computers.

A computer program can be written in any form of programming language, including compiled or interpreted languages, and it can be deployed in any form, including as a standalone program or as a module, subroutine, or other unit suitable for use in a computing environment. A computer program can be deployed to be executed on one computer or on multiple computers at one site or distributed across multiple sites and interconnected by a communication network.

In example embodiments, operations may be performed by one or more programmable processors executing a computer program to perform functions by operating on input data and generating output. Method operations can also be performed by, and apparatus of example embodiments may be implemented as, special purpose logic circuitry, e.g., an FPGA or an ASIC.

The computing system can include clients and servers. A client and server are generally remote from each other and typically interact through a communication network. The relationship of client and server arises by virtue of computer programs running on the respective computers and having a client-server relationship to each other. In embodiments deploying a programmable computing system, it will be appreciated that both hardware and software architectures require consideration. Specifically, it will be appreciated that the choice of whether to implement certain functionality in permanently configured hardware (e.g., an ASIC), in temporarily configured hardware (e.g., a combination of software and a programmable processor), or in a combination of permanently and temporarily configured hardware may be a design choice. Below are set out hardware (e.g., machine) and software architectures that may be deployed, in various example embodiments.

Example Machine Architecture and Machine-Readable Medium

Figure 7:
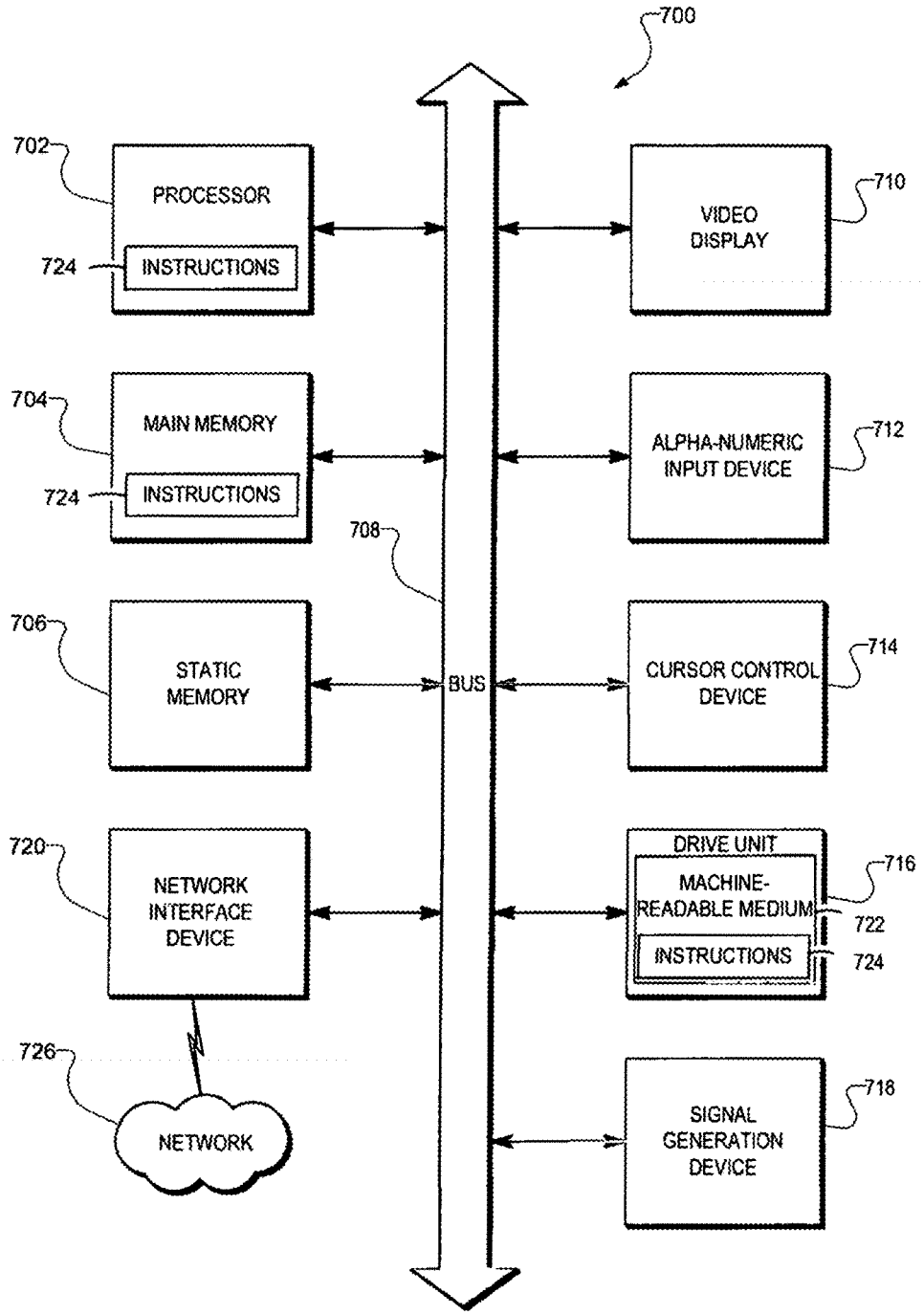
FIG. 7 is a block diagram of a machine within which instructions may be executed for causing the machine to perform any one or more of the methodologies discussed herein.

FIG. 7 is a block diagram of a machine in the example form of a computer system 700 within which instructions may be executed for causing the machine to perform any one or more of the methodologies discussed herein. In one example embodiment, the machine may be the example apparatus 200 of FIG. 2 for monitoring a vehicle. In alternative embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (STB), a personal digital assistant (PDA), a cellular telephone, a web appliance, a network router, switch, or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 700 includes a processor 702 (e.g., a central processing unit (CPU), a graphics processing unit (GPU), or both), a main memory 704, and a static memory 706, which communicate with each other via a bus 708. The computer system 700 may further include a video display unit 710 (e.g., a liquid crystal display (LCD) or a cathode ray tube (CRT)). The computer system 700 also includes an alphanumeric input device 712 (e.g., a keyboard), a user interface (UI) navigation (or cursor control) device 714 (e.g., a mouse), a disk drive unit 716, a signal generation device 718 (e.g., a speaker), and a network interface device 720.

Machine-Readable Medium

The drive unit 716 includes a machine-readable medium 722 on which is stored one or more sets of data structures and instructions 724 (e.g., software) embodying or utilized by any one or more of the methodologies or functions described herein. The instructions 724 may also reside, completely or at least partially, within the main memory 704 and/or within the processor 702 during execution thereof by the computer system 700, the main memory 704 and the processor 702 also constituting machine-readable media 722. The instructions 724 may also reside within the static memory 706.

While the machine-readable medium 722 is shown in an example embodiment to be a single medium, the term "machine-readable medium" may include a single medium or multiple media (e.g., a centralized or distributed database, and/or associated caches and servers) that store the one or more data structures or instructions 724. The term "machine-readable medium" shall also be taken to include any tangible medium that is capable of storing, encoding, or carrying the instructions 724 for execution by the machine and that cause the machine to perform any one or more of the methodologies of the present inventive subject matter, or that is capable of storing, encoding, or carrying data structures utilized by or associated with such instructions 724. The term "machine-readable medium" shall accordingly be taken to include, but not be limited to, solid-state memories, and optical and magnetic media. Specific examples of machine-readable media 722 include non-volatile memory, including by way of example semiconductor memory devices, e.g., erasable programmable read-only memory (EPROM), electrically erasable programmable read-only memory (EEPROM). and flash memory devices; magnetic disks such as internal hard disks and removable disks; magneto-optical disks; and CD-ROM and DVD-ROM disks.

Transmission Medium

The instructions 724 may further be transmitted or received over a communications network 726 using a transmission medium. The instructions 724 may be transmitted using the network interface device 720 and any one of a number of well-known transfer protocols (e.g., hypertext transfer protocol (HTTP)). Examples of communications networks 726 include a local area network (LAN), a wide area network (WAN), the Internet, mobile telephone networks, plain old telephone (POTS) networks, and wireless data networks (e.g., WiFi and WiMax networks). The term "transmission medium" shall be taken to include any intangible medium that is capable of storing, encoding, or carrying the instructions 724 for execution by the machine, and includes digital or analog communications signals or other intangible media to facilitate communication of such instructions 724.

Although an embodiment has been described with reference to specific example embodiments, it will be evident that various modifications and changes may be made to these embodiments without departing from the broader spirit and scope of the inventive subject matter. Accordingly, the specification and drawings are to be regarded in an illustrative rather than a restrictive sense. The accompanying drawings that form a part hereof show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments.

Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, the apparatus comprising:

a speed regulator configurable to extend and retract;

a monitor to detect a speed of a vehicle; and a speed regulator controller to retract the speed regulator from an extended configuration prior to the vehicle encountering the speed regulator in response to the detected speed being less than or equal to a first defined speed and the vehicle being within a predefined distance of the speed regulator.

2. The apparatus of claim 1, wherein a default configuration of the speed regulator is one of fully retracted, partially retracted, or extended.

3. The apparatus of claim 1, wherein the speed regulator, in a second mode, is raised into the extended configuration in response to the vehicle exceeding a second defined speed.

4. The apparatus of claim 1, wherein the speed regulator is maintained in the extended configuration in response to the vehicle exceeding a second defined speed.

5. The apparatus of claim 1, wherein the speed regulator is maintained in the retracted configuration in response to the vehicle traveling at a speed less than a defined speed.

6. The apparatus of claim 1, wherein the speed regulator is maintained in an existing configuration in response to the vehicle being within a predefined distance of the speed regulator.

7. A method for controlling a speed regulator, the method comprising:

detecting a speed of a vehicle; and retracting the speed regulator from an extended configuration to a retracted configuration prior to the vehicle encountering the speed regulator in response to the detected speed being less than or equal to a first defined speed and the vehicle being within a predefined distance of the speed regulator, the speed regulator being capable of being extended and retracted.

8. The method of claim 7, further comprising raising, in a second mode, the speed regulator into the extended configuration in response to the vehicle exceeding a defined speed.

9. The method of claim 7, further comprising maintaining the speed regulator in the extended configuration in response to the vehicle exceeding a defined speed.

10. The method of claim 7, further comprising maintaining the speed regulator in the retracted configuration in response to the vehicle traveling at a speed less than the defined speed.

11. The method of claim 7, further comprising retracting the speed regulator: at a specified amount of time after the vehicle is first detected, or based on an estimated time of the vehicle encountering the speed regulator.

12. The method of claim 7, further comprising maintaining the speed regulator in an existing configuration in response to the vehicle being within a predefined distance of the speed regulator.

13. The method of claim 7, further comprising raising the speed regulator into the extended configuration after the vehicle has passed the speed regulator.

14. The method of claim 7, further comprising retracting the speed regulator after the vehicle has passed the speed regulator.

15. A non-transitory machine-readable storage medium comprising instructions, which when implemented by one or more machines, cause the one or more machines to perform operations comprising:

detecting a speed of a vehicle; and retracting a speed regulator from an extended configuration to a retracted configuration prior to the vehicle encountering the speed regulator in response to the detected speed being less than or equal to a defined speed and the vehicle being within a predefined distance of the speed regulator, the speed regulator being capable of being extended and retracted.

16. The non-transitory machine-readable storage medium of claim 15, wherein the speed regulator is maintained in an existing configuration in response to the vehicle being within a predefined distance of the speed regulator.

17. The apparatus of claim 1, wherein the speed regulator comprises a plurality of flat shutters and a shutter base, the speed regulator controller configured to raise at least one of the shutters to protrude from the shutter base in the extended configuration.

18. An apparatus, the apparatus comprising:

a speed regulator configurable to extend and retract;

a monitor to detect a speed of a vehicle; and a speed regulator controller to retract the speed regulator from an extended configuration based on an estimated time of the vehicle encountering the speed regulator and prior to the vehicle encountering the speed regulator, and in response to the detected speed being less than or equal to a first defined speed.

19. A method for controlling a speed regulator, the method comprising:

detecting a speed of a vehicle; and retracting the speed regulator from an extended configuration to a retracted configuration based on an estimated time of the vehicle encountering the speed regulator and prior to the vehicle encountering the speed regulator, and in response to the detected speed being less than or equal to a first defined speed, the speed regulator being capable of being extended and retracted.

20. An apparatus, the apparatus comprising:

a speed regulator configurable to extend and retract;

a monitor to detect a speed of a vehicle; and a speed regulator controller to retract the speed regulator from an extended configuration in response to the detected speed being less than or equal to a first defined speed, the retraction performed prior to the vehicle encountering the speed regulator and at a specified amount of time after the vehicle is first detected.

21. A method for controlling a speed regulator, the method comprising:

detecting a speed of a vehicle; and retracting the speed regulator from an extended configuration to a retracted configuration in response to the detected speed being less than or equal to a first defined speed, the retraction performed prior to the vehicle encountering the speed regulator and at a specified amount of time after the vehicle is first detected.

* * * * *